US011400494B2

(12) United States Patent
Ye et al.

(10) Patent No.: US 11,400,494 B2
(45) Date of Patent: Aug. 2, 2022

(54) SYSTEM FOR PROCESSING OBJECTS WITH PARTICULATE CONTAMINANTS

(71) Applicant: Li Tong (Jiangmen) Environment Technology Co., Ltd., Jiangmen (CN)

(72) Inventors: Gang Ye, Wangcheng (CN); Caitian Liu, Shanghai (CN)

(73) Assignee: Li Tong (Jiangmen) EnvironmentTechnology Co., Ltd, Wangcheng (CN)

( * ) Notice: Subject to any disclaimer, the term of this patent is extended or adjusted under 35 U.S.C. 154(b) by 562 days.

(21) Appl. No.: 16/186,666

(22) Filed: Nov. 12, 2018

(65) Prior Publication Data

US 2019/0366393 A1 Dec. 5, 2019

(30) Foreign Application Priority Data

May 29, 2018 (CN) ..... 201810533807.X

(51) Int. Cl.
*B08B 5/04* (2006.01)
*B41J 29/17* (2006.01)
*G03G 21/20* (2006.01)

(52) U.S. Cl.
CPC ..... *B08B 5/04* (2013.01); *B41J 29/17* (2013.01); *G03G 21/206* (2013.01)

(58) Field of Classification Search
CPC .. B08B 5/04; B08B 5/02; B08B 15/02; B08B 15/007; B41J 29/17; G03G 21/206; B09B 3/00; B09B 5/00
See application file for complete search history.

(56) References Cited

U.S. PATENT DOCUMENTS 5,277,208 A * 1/1994 Mansur ..... B08B 3/02 134/107
2007/0256258 A1* 11/2007 Takayanagi ..... B08B 6/00 15/1.51
2012/0247512 A1* 10/2012 Wu ..... B08B 9/34 134/21
2016/0207076 A1 7/2016 Wagner et al.

FOREIGN PATENT DOCUMENTS

CN 2621092 6/2004
CN 203494835 3/2014
CN 105744710 7/2016
CN 206444995 8/2017
DE 102013002129 8/2014
KR 1020170008448 * 10/2017 ..... A47L 23/22

OTHER PUBLICATIONS

Machine translation of KR1020170008448 (Year: 2017).*
Hong Kong Search Report.

* cited by examiner

*Primary Examiner* — Erin F Bergner
(74) *Attorney, Agent, or Firm* — Renner Kenner Greive Bobak Taylor & Weber

(57) ABSTRACT

A system for processing objects with particulate contaminants includes a processing station having a holder for holding an object to be processed. The system also includes a suction means in fluid communication with the processing station for removing particulate contaminants from the processing station.

25 Claims, 5 Drawing Sheets

SYSTEM FOR PROCESSING OBJECTS WITH PARTICULATE CONTAMINANTS

TECHNICAL FIELD

The invention relates to a system for processing objects with particulate contaminants.

BACKGROUND

A conventional way of processing and scrapping used products for recycling involves manual disassembly of the products into smaller pieces. To date, most of such disassembly and dismantling processes require a worker to, manually, often forcefully and brutally, disassemble the larger product into smaller pieces. In the disassembly and dismantling process, a large amount of dust and debris stored inside the product may be dislodged. Such dust and debris may create a mess, soiling or polluting the environment. Cumbersome clean-up may be required to remove them. The dust and debris may also pose substantial health-related risk to the workers.

SUMMARY OF THE INVENTION

It is an object of the invention to address the above needs, to overcome or substantially ameliorate the above disadvantages or, more generally, to provide an improved system for processing objects with particulate contaminants.

In accordance with a first aspect of the invention, there is provided a system for processing object with particulate contaminants, comprising: a processing station comprising a holder for holding an object to be processed, and a suction means in fluid communication with the processing station for removing particulate contaminants from the processing station.

Preferably, the processing station further comprises one or more nozzles arranged to be in fluid communication with a fluid source for directing fluid to the object and thereby removing particulate contaminants from the object.

The one or more nozzles are preferably movable relative to the holder. The movement can be translation or rotation or both, sequentially or simultaneously. The one or more nozzles may be moved manually. Alternatively or additionally, the system may further include a controller for controlling movement of the nozzles. The controller may control the operation of the nozzles based on one or more predetermined programs, to selectively adjust the position of the nozzle and to selectively control the amount or pressure of fluid dispensed from the nozzle.

In one embodiment, the one or more nozzles are directed towards the holder. In the embodiment in which the one or more nozzle is movable, the one or more nozzles can be moved into a position such that they are directed towards the holder.

The nozzles may form one or more arrays each movable relative to the holder. In one embodiment, the system includes multiple arrays of nozzles, at least two of which are opposing each other.

Preferably, the holder includes a base with through-holes through which the particulate contaminants can pass. The base may provide a generally horizontal support surface on which the object may rest, and the dislodged particulate contaminants may pass through the through-holes under gravity.

Preferably, the base is rotatable. The rotation is preferably 360 degrees, and can be in clockwise or anti-clockwise direction.

Preferably, the suction means is arranged to be in fluid communication with the through-holes for drawing the particulate contaminants through the through-holes. In one embodiment, the dislodged particulate contaminants may be removed by the combined effect of gravity and suction.

Preferably, the system also includes a collector with a body defining an inlet through which the particulate contaminants that have passed through the through-holes can pass; and an outlet for fluid connection with the suction means. The collector can be arranged underneath the base of the holder.

Preferably, the fluid source is a pressurized fluid source. The fluid source may be a source of pressurized gas, such as air. One or more sources may be used. For example, a first set of nozzles may dispense a first type of fluid and a second first set of nozzles may dispense a second type of fluid different from the first type of fluid. The fluid can be a desiccant, and it may be warmed, to facilitate removal of the particulate contaminants, Preferably, the suction means comprises a motor-fan assembly and a pre-motor filter arranged upstream of the motor-fan assembly for preventing the particulate contaminants from reaching the motor-fan assembly. Without the pre-motor filter, the particulate contaminants may enter the motor-fan assembly, posing explosion risk.

The system may further include a particulate contaminant collector for collecting the removed particulate contaminants. The particulate contaminant collector may collect the particulate contaminants, after which they may be recycled.

Preferably, the system further includes a shield with a housing defining a chamber in which the holder and the one or more nozzles are arranged. The housing may include one or more doors. Additionally or alternatively, the housing includes a viewing window through which inside of the chamber can be viewed. The system may have a controller for controlling opening and closing of the one or more doors.

Preferably, the system further includes at least one sensor, the at least one sensor comprises a temperature sensor, a pressure sensor, a particulate concentration sensor, preferably arranged in the chamber, to detect corresponding conditions in the chamber.

The system may further include a controller, operably connected with the at least one sensor. The controller may control fluid dispensed from the nozzles based on conditions sensed by the at least one sensor.

Preferably, the system further includes one or more further processing stations arranged adjacent the processing station. The processing station and the one or more further processing stations may form a 1D array or a 2D array in plan-view. The shield may be arranged to move between processing stations. The movement of the shield may be controlled by a controller.

Preferably, the system further includes a suction module arranged between adjacent rows in the 2D array. The suction module may extend substantially vertically between the adjacent rows in the 2D array. Multiple such suction modules may be provided.

Preferably, the system further includes a loading station arranged for loading the object to the system. The loading station may be arranged adjacent one of the processing stations.

Preferably, the object includes one or more parts of a copying machine, a printer, a cartridge, or any combination thereof. The object may be disassembled parts of a copying machine, a printer, a cartridge, or any combination thereof.

The particulate contaminants may be toner, dust, their combination, etc.

The various controllers, including the controller for controlling movement of the nozzles, the controller for controlling opening and closing of the one or more doors, the controller for controlling movement of the shield, etc., may be implemented jointly in a single controller or processing unit, or alternatively, in two or more separate controllers or processing units (various combination).

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1:
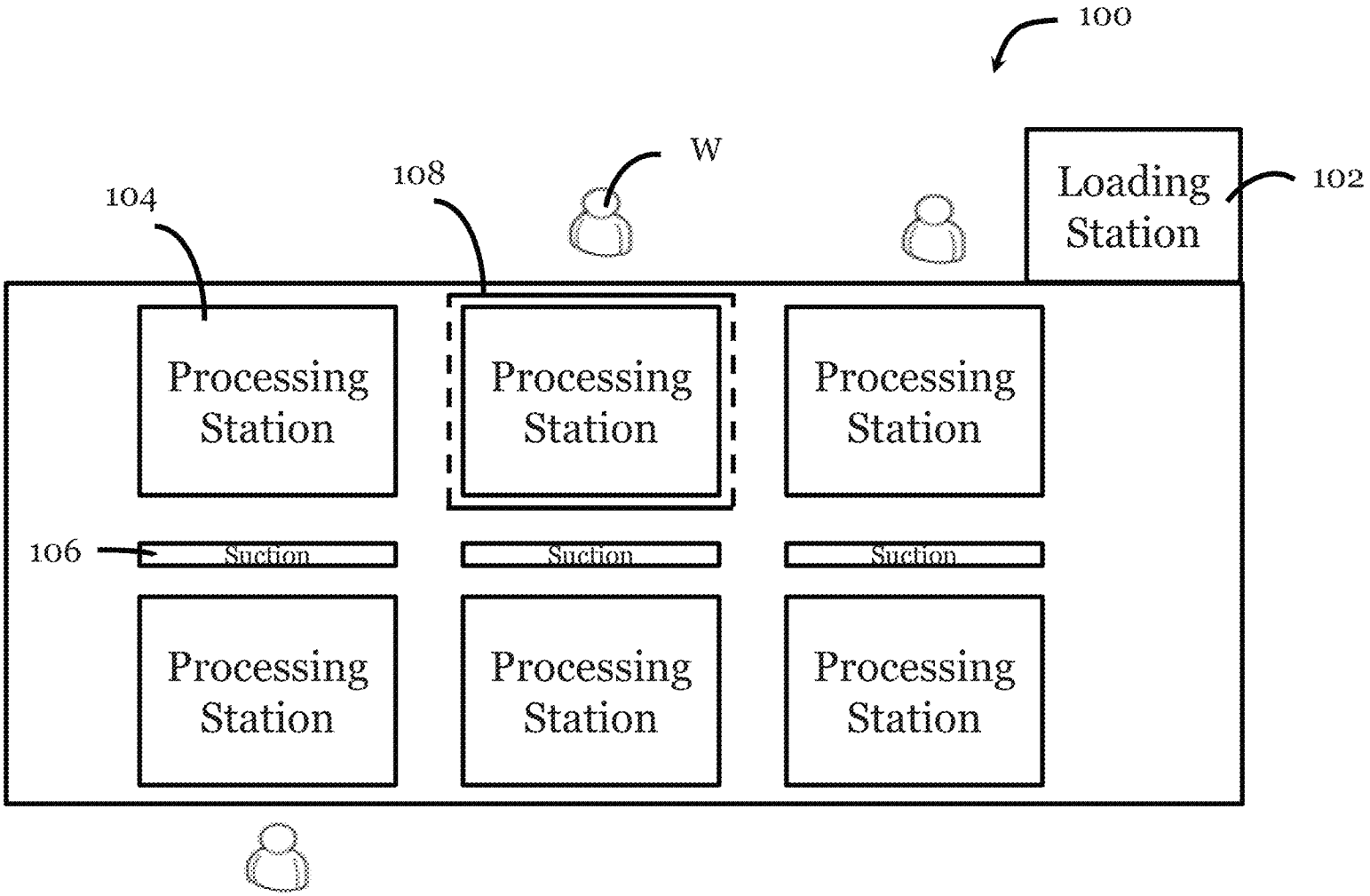
FIG. 1 is a block diagram of a system for processing objects with particulate contaminants in one embodiment of the invention.

FIG. 1 shows a system 100 for processing objects, such as disassembled copying machine parts adhered with toners and dust. The system 100 includes a loading station 102 arranged to facilitate loading of the objects to be processed to the system 100. Six processing stations 104 are arranged in the system to allow different workers W to process different objects simultaneously. As shown in FIG. 1, the processing stations 104 are arranged in a 2D array, with two rows and three columns in plan-view. Suction modules 106 are arranged between corresponding processing stations 104 of the same column. The system 100 also includes a shield 108 arranged at one of the processing stations 106. The shield 108 is arranged to shield the worker from toners and dust during processing operation.

Figure 2A:
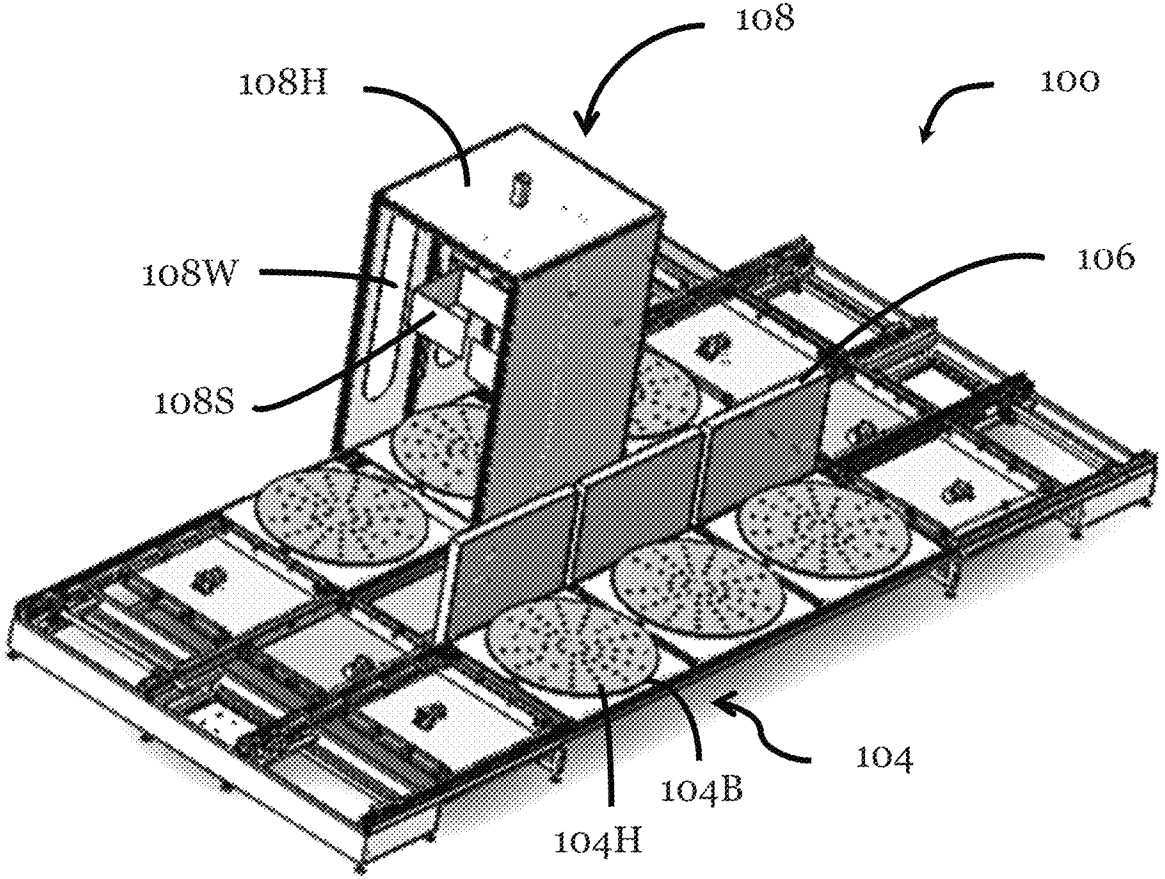
FIG. 2A is a schematic diagram of the system in FIG. 1.
Figure 2B:
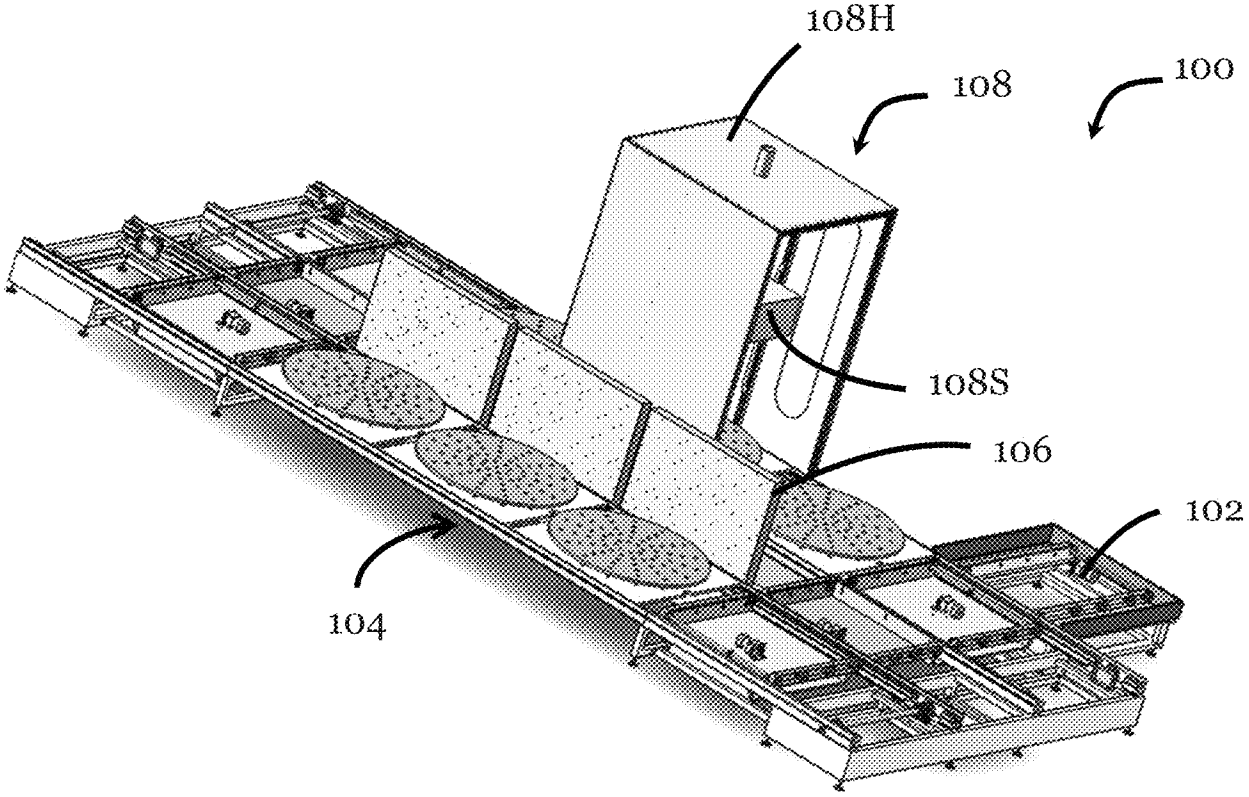
FIG. 2B is another schematic diagram of the system in FIG. 1.

FIGS. 2A and 2B show the schematic diagram of the system 100 in FIG. 1. As shown in FIGS. 2A and 2B, each of the six processing stations 104 includes a holder for holding an object to be processed. Each holder includes a generally circular base 104B providing a generally horizontal support surface. Each base 104B includes through-holes 104H through which the particulate contaminants can pass under gravity. The through-holes 104H on the holder are arranged in a pattern formed by inner concentric circles and radial extensions in plan-view. The base 104B is rotatable in 360 degrees, preferably in both directions, such that worker can easily manipulate the base 104B to process different parts (sides) of the object. A rotation mechanism such as roller balls and guide rail can be used to facilitate rotation of the base 104B.

The system 100 also includes a generally rectangular shield 108 with a housing 108H. The shield 108 may be movable between processing stations 104, at least those in the same row, under manual control or electronic control using a controller. By moving the shield 108 between processing stations 104, the processing job can be streamlined. The shield housing 108H includes a wall on the side nearest to the operator (along the edge) and an opposite wall, with opposed closable doors (shown as opened gates, rolled up, in the Figures) arranged between the two walls. Opening and closing of the doors may be controlled manually or electronically using a controller. Windows 108W, transparent or translucent, are provided on the wall on the side nearest to the operator, to facilitate visual inspection of the chamber in the shield housing 108H. This is particularly useful when the doors are closed during processing such that the housing 108H provides a substantially enclosed space.

Inside the housing 108H there is arranged a holder with base 104B (like the one as described above) and spray nozzles 108S. The spray nozzles 108S are arranged to be in fluid communication with a fluid source (not shown), preferably pressurized air, for directing fluid to the object (when placed in the processing station 104 at which the shield 108 is arranged) and thereby removing particulate contaminants from the object. As described above, dislodged or loose dust and toner fall through the base 104B and are drawn away from the corresponding processing station 104.

The spray nozzles 108S are movable relative to the holder. In this embodiment the movement is translation, however in other cases the movement may be translation (vertical, horizontal, or both), rotation, or both, sequentially or simultaneously. Movement of the nozzles 108S may be controlled manually or electronically via a controller. The controller may control the operation of the nozzles 108S based on one or more predetermined programs, to selectively adjust the position and orientation of the nozzles 108S, and to selectively control the amount or pressure of fluid dispensed from the nozzles 108S. The spray nozzles 108S can be directed towards the holder such that the fluid impinged on the object drives the dislodged and loose dust and toner towards the base 104B to be removed. In this embodiment, the spray nozzles 108S form two opposed lateral arrays, each having multiple nozzles and a top array (FIG. 3B).

Referring to FIGS. 2A and 2B, the system 100 also includes suction means 106, three generally vertical suction panels, arranged between respective processing stations 104 in adjacent rows. The suction panels 106, spaced apart from each other and arranged in a linear array in plan-view, are arranged to be in fluid communication with the processing station 104 for removing particulate contaminants from the processing station 104. In this example, suction is provided on the side of the suction panels 106 opposite the shield 108. One or more suction sources (not shown, but similar to those described further below) may be fluidly connected with the suction panels 106.

The loading station 102 is arranged at a corner of the system 100. The loading station 102 includes transport means, such as rails, belts, conveyor, etc., that facilitates loading the object to the system 100.

Figure 3B:
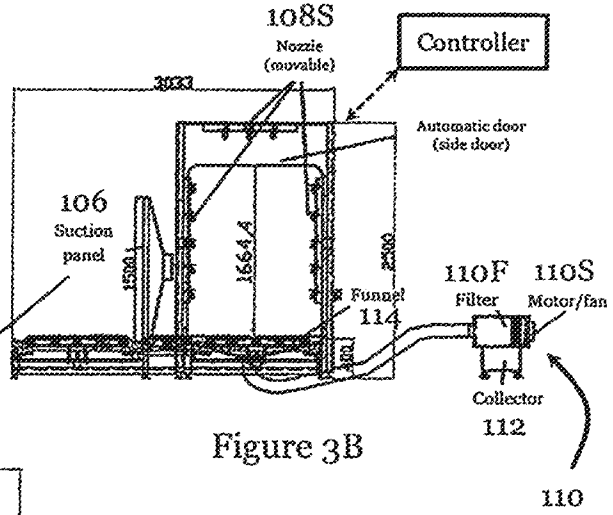
FIG. 3B is a sectional view taken from line A-A in FIG. 3A.
Figure 3A:
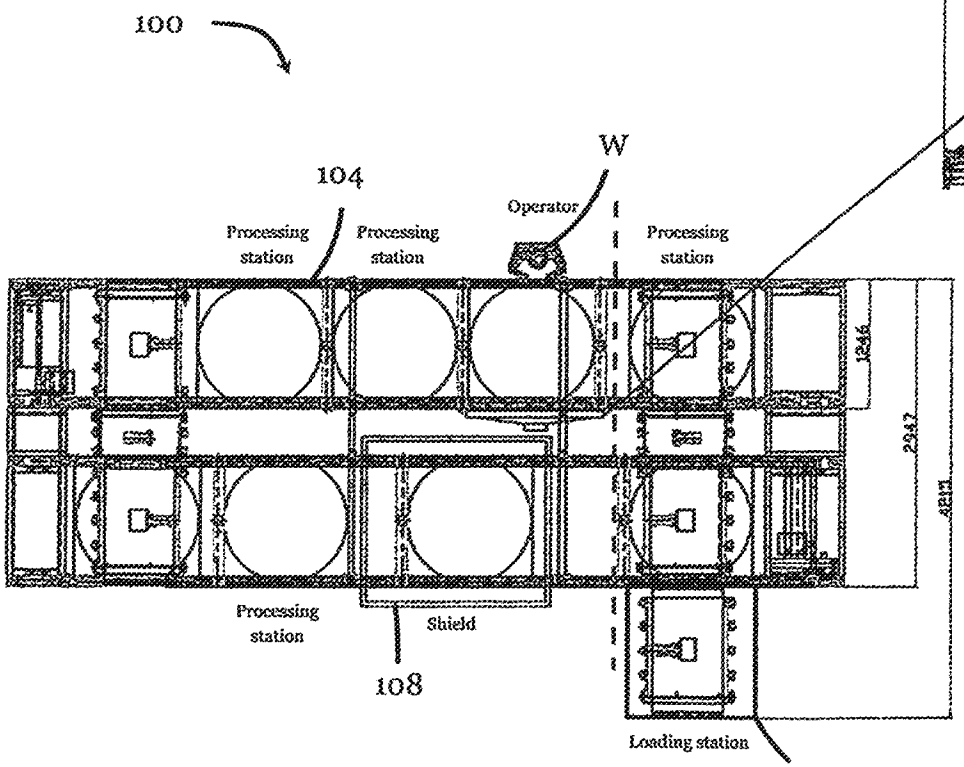
FIG. 3A is a top view of the system in FIGS. 2A and 2B.

FIGS. 3A and 3B are other views of the system 100 in FIGS. 2A and 2B. As shown in FIG. 3B, a suction means 110, with a motor-fan assembly 110S and a pre-motor filter 110F arranged upstream of the motor-fan assembly 110S for preventing the particulate contaminants from reaching the motor-fan assembly 110S, is operably connected to the base 104B at the processing station 104 at which the shield 108 is arranged. FIG. 3B also shows a particulate contaminant collector 112 provided in the flow path downstream of the base 104B for collecting the removed particulate contaminants.

Figure 4A:
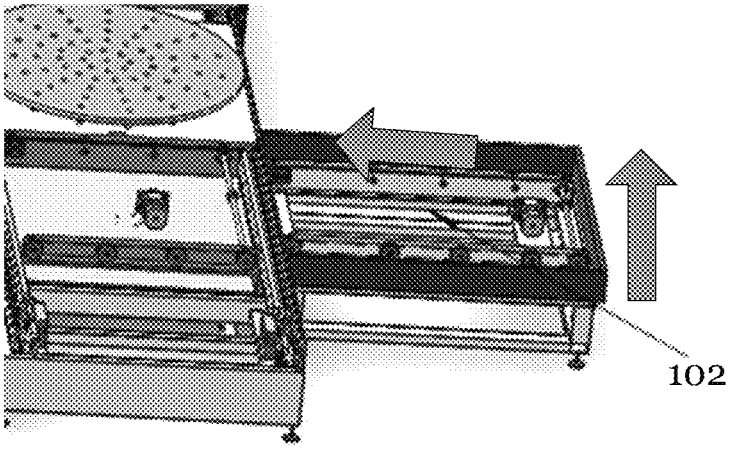
FIG. 4A is a perspective view of the loading station in the system of FIGS. 2A and 2B.

FIG. 4A shows the loading station 102 which can raise a loaded object and then translate it onto the system platform.

Figure 4B:
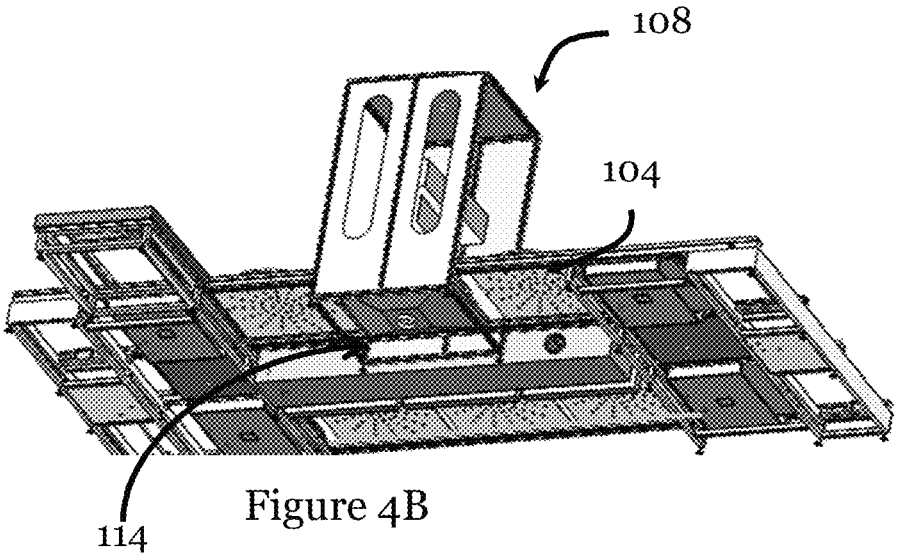
FIG. 4B is a perspective view (viewed from bottom) of the system in FIGS. 2A and 2B.

FIG. 4B shows a collector 114 with a body defining an inlet through which the particulate contaminants that have passed through the through-holes 104H can pass and an outlet for fluid connection with the suction means can be arranged underneath the base 104B of the holder. The collector 114 may be shaped like a funnel, or generally tapered to narrow from the inlet to the outlet, to facilitate collection of the contaminants. A suction means, like the one in FIG. 3B, may be coupled to the outlet of the collector such that the suction means is arranged to be in fluid communication with the through-holes 104H for drawing the particulate contaminants through the through-holes 104H. The particulate contaminants that fall off during manual operation or impact may be removed by the combined effect of gravity and suction. It is possible for all processing stations to be connected with a respective suction means, or alternatively, that the same suction means is selectively coupled with two or more (but not all) of the processing stations 104.

The various controllers in the system 100, including the controller for controlling movement of the nozzles, the controller for controlling opening and closing of the one or more doors of the shield, the controller for controlling movement of the shield between processing stations, etc., may be implemented jointly in a single controller or processing unit, or alternatively, in two or more separate controllers or processing units (various combination). The controller is preferably a programmable logic controller, with a CPU, an MCU, raspberry PI, etc., which is preferably operably connected with a memory unit such as a volatile memory unit (such as RAM), a non-volatile unit (such as ROM, EPROM, EEPROM and flash memory) or both. The controller may further be connected with input devices such as a control button, panel, etc., and output devices such as displays, for providing a user interface. The controller facilities semi-automation of the system, reducing the amount of manual work required and improving the processing effectiveness and efficiency.

In operation, the workers first load the objects to be processed onto the loading station 102. After that, the loading station 102 transfers the objects to the system platform. The workers can then place the objects onto respective processing stations 104, to perform manual cleaning and processing operations. The workers may rotate the base 104B as necessary to manipulate the object. During such operation, the suction panels 106 provide suction to remove loose or dislodged particulates contaminants. One of the processing stations 104 is shielded by the shield 108. The door of the shield 108 may be closed manually or automatically when it detects the presence of an object inside the chamber of the shield housing 108H. The object in the processing station 104 at which the shield 108 is arranged is then blasted with pressurized fluid, e.g., air, through the nozzles 108S to loosen and dislodge the particulate contaminants. The nozzles 108S may translate or rotate such that the object is impinged with pressurized fluid at different angles and height. Loosen and dislodged particulate contaminants fall through the base 104B, to the collector 114, via both gravity and suction by suction source, and then collected in a collector 112. Once the processing is complete, the doors of the shield 108 can be opened and the worker can remove the processed objects. In some cases, the shield 108 may then move to the next processing station 104 to process another object in that station. Finally, all processed objects can be removed from the system 100, e.g., from the respective processing stations 104, and new objects to be processed can be loaded and the cycle can be repeated.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

For example, the system in the above embodiments can be used to process other objects such as one or more parts of a copying machine, a printer, a cartridge, or any combination thereof. The particulate contaminants may be dust, toner, etc. Also, the loading station is optional, and its location may be changed. The number of processing stations may vary. The processing modules need not be arranged in a row-and-column configuration, but can be, for example, arranged in a linear array, circular array, etc. The form, size, and number of suction modules between the processing modules may vary. In one embodiment, the nozzles may be fixed. The number and specific arrangement and orientation of the nozzles may vary, depending at least partly on the objects to be processed in the system. In another embodiment, the nozzles may be movable, via translation or rotation or both. In some other embodiments, some nozzles may be fixed and some movable. The fluid source is preferably dry air, but it may be any other fluid source (preferably gas). The temperature of the fluid source is preferably warm, or even hot, but it may be cool or cold in some cases. The base of the processing station may be fixed, i.e., not rotatable. The shape of the base need not be circular. The shield may be movable between processing stations. The shield may cover more than one holder. Structure of the shield may vary. For example, the doors and windows are optional. The shape of the collector beneath the base need not be tapered or funneled. The number of suction means may vary.

Although not illustrated, the system may further include at least one sensor, e.g., a temperature sensor, a pressure sensor, a particulate concentration sensor, arranged in the chamber or at one or more processing stations, to perform corresponding measurements to effect operation of the controllers. For example, the controller may control fluid dispensed from the nozzles based on conditions sensed by the sensor.

The invention claimed is:

1. A system for processing an object with particulate contaminants, the system comprising:

a plurality of processing stations arranged in a 1D array in plan-view, each of the plurality of processing stations comprising, respectively, a holder with a base plate providing a generally horizontal support surface on which an object to be processed may rest, the base plate being rotatable about a generally vertical axis and including through-holes through which particulate contaminants removed from the object can pass; and a shield arranged at one of the plurality of processing stations and comprising a housing defining a chamber in which the holder of the processing station at which the shield is arranged; and one or more nozzles arranged in the chamber, the one or more nozzles being arranged to be in fluid communication with a fluid source for directing fluid to the object on the holder of the processing station at which the shield is arranged and thereby removing particulate contaminants from the object; and a suction means in fluid communication with the processing station at which the shield is arranged, for removing particulate contaminants from the processing station at which the shield is arranged;

wherein the shield is slidable between the plurality of processing stations.

2. The system of claim 1, wherein the one or more nozzles are at least translatable relative to the housing.

3. The system of claim 1, wherein the one or more nozzles are directed towards the holder of the one of the plurality of processing stations at which the shield is arranged.

4. The system of claim 2, wherein the one or more nozzles form one or more arrays, each being at least translatable relative to the housing.

5. The system of claim 2, further comprising a controller for controlling movement of the one or more nozzles.

6. The system of claim 1, wherein the suction means is arranged to be in fluid communication with the through-holes for drawing the particulate contaminants through the through-holes.

7. The system of claim 1, further comprising a collector with a body defining:

an inlet through which the particulate contaminants that have passed through the through-holes can pass; and an outlet for fluid connection with the suction means.

8. The system of claim 1, wherein the fluid source is a pressurized fluid source.

9. The system of claim 1, wherein the fluid source is a source of pressurized gas.

10. The system of claim 1, wherein the fluid source is a source of pressurized air.

11. The system of claim 1, wherein the suction means comprises a motor-fan assembly and a pre-motor filter arranged upstream of the motor-fan assembly for preventing the particulate contaminants from reaching the motor-fan assembly.

12. The system of claim 1, further comprising a particulate contaminant collector for collecting the removed particulate contaminants.

13. The system of claim 1, wherein the housing comprises one or more doors, where the one or more doors can be closed such that the chamber is a substantially enclosed chamber.

14. The system of claim 13, further comprising a controller for controlling opening and closing of the one or more doors.

15. The system of claim 1, wherein the housing comprises a viewing window through which inside of the chamber can be viewed.

16. The system of claim 1, further comprising at least one sensor, the at least one sensor comprises a temperature sensor, a pressure sensor, or a particulate concentration sensor arranged in the chamber.

17. The system of claim 16, further comprising a controller operably connected with the at least one sensor, the controller being arranged to control fluid dispensed from the one or more nozzles based on conditions sensed by the at least one sensor.

18. The system of claim 1, further comprising:

a further plurality of processing stations, the further plurality of processing stations and the plurality of processing stations being arranged to form a 2D array in plan view, and a suction module arranged between adjacent rows in the 2D array.

19. The system of claim 18, wherein the suction module extends substantially vertically between the adjacent rows in the 2D array.

20. The system of claim 1, further comprising a loading station arranged for loading the object to the system.

21. The system of claim 20, wherein the loading station is arranged adjacent one of the plurality of processing stations.

22. The system of claim 1, wherein the object includes one or more parts of a copying machine, a printer, a cartridge, or any combination thereof.

23. The system of claim 1, wherein the particulate contaminants comprise at least one of toner and dust.

24. The system of claim 1, further comprising a controller for controlling movement of the shield between the plurality of processing stations.

25. The system of claim 1, wherein the object includes one or more parts of a copying machine, a printer, a cartridge, or any combination thereof; and wherein the particulate contaminants comprise at least one of toner and dust.

* * * * *